United States Patent [19]

Valtonen

[11] 4,089,578

[45] May 16, 1978

[54] ANGLE PIECE FOR A CONTACT RAIL

[75] Inventor: Rainer Ilkka Tapio Valtonen, Espoo, Finland

[73] Assignee: Oy Nokia AB, Helsinki, Finland

[21] Appl. No.: 782,554

[22] Filed: Mar. 29, 1977

[30] Foreign Application Priority Data

Apr. 1, 1976 Finland ..... 760880

[51] Int. Cl.[2] ..... H01R 9/00

[52] U.S. Cl. ..... 339/21 R

[58] Field of Search ..... 339/20–24, 339/31 R, 31 M, 185

[56] References Cited

U.S. PATENT DOCUMENTS

| | | | |
|---|---|---|---|
| 3,792,413 | 2/1974 | Hyrlainen | 339/21 R |
| 3,825,879 | 7/1974 | Hesse | 339/21 R |
| 3,871,730 | 3/1975 | Hesse | 339/21 R |

FOREIGN PATENT DOCUMENTS

| | | | |
|---|---|---|---|
| 1,401,300 | 7/1975 | United Kingdom | 339/22 R |

*Primary Examiner*—Neil Abrams
*Attorney, Agent, or Firm*—Haseltine, Lake & Waters

[57] ABSTRACT

An angle piece for a contact rail of U-shaped section and provided with longitudinal conductors. The L-shaped angle piece can be pushed into the groove of two contact rails forming an angle between them, thereby establishing contact between the conductors of the two rails via contact fingers provided on an installation component of the angle piece supported by a body portion. The installation component can be shifted in relation to the body portion diagonally so as to adjust the relative position of the contact fingers to flanks of the body portion.

3 Claims, 9 Drawing Figures

ANGLE PIECE FOR A CONTACT RAIL

BACKGROUND OF THE INVENTION

The subject of the present invention is an angle piece for a contact rail, which rail comprises a support body of U-shaped section provided with longitudinal conductors placed in the longitudinal groove of the support body excentrically in relation to the sides of the support body, whereby the angle piece, with its end portion, comprises an L-shaped body portion which can be pushed into the groove of the support body longitudinally and which is, at each end portion, provided with contact fingers so as to contact the conductors in the support body. The contact fingers are placed eccentrically in relation to the inner and outer flanks of the body portion and the contact fingers are mounted onto an installation component supported by the body portion and adjustable in relation to the body portion.

Contact rails of this type are commonly used in the electrical distribution system of various lighting appliances and apparatuses. The distribution system is assembled into a suitable system of current contact rails out of individual contact rails, which are connected to each other by means of appropriate connecting pieces. When two contact rails must be connected to each other in an angular position, an L-shaped angle piece is used, both of whose end portions are inserted into the corresponding contact rail, whereby the contact fingers of the angle piece reach contact with the conductors in the contact rails.

When such a current contact rail system is assembled, it is important that the various conductors (zero and phase conductors) of one contact rail are connected correctly to the conductors of the next contact rail so that the conductors of the next contact rail continue as of the same phase. In order to ensure this, a known arrangement is to mount the conductors in the contact rail as positioned in the longitudinal groove of the U-shaped support body eccentrically in relation to the sides of the support body and, correspondingly, to arrange the conductors in the angle piece also eccentrically. In this way it can be achieved that to the contact rail it is only possible to connect such an angle piece in which the contact finger, e.g., of the zero conductor is placed in the end portion of the angle piece on the same side, e.g., on the side of the inside, as the zero conductor in the contact rail and that, correspondingly, to the other end portion of the angle piece, it is possible to connect a contact rail only in a position in which the zero conductor of the rail is placed on the inside side of the angle piece.

Such a means of security, however, causes the drawback that two types of angle pieces are required, i.e. angle pieces in which the eccentricity of the contact fingers is towards the inside and angle pieces in which the eccentricity is towards the outside, for connecting a contact rail continuing from the contact rail to the right, and to the left, respectively.

The purpose of the present invention is to provide an angle piece that eliminates the above drawback, and this purpose is achieved by means of the angle piece in accordance with the present invention, which is characterized in that the L-shaped installation component can be shifted in relation to the body portion in its diagonal direction so that the contact fingers can be selectively adjusted so as to come closer to the inside flank or closer to the outside flank of the body portion.

SUMMARY OF THE INVENTION

In accordance with the invention, an angle piece is provided in which the eccentricity of the contact fingers can be simply shifted from one side of the angle piece to the other side. In this way it is possible to shift the eccentricity of the contact fingers of one end portion of the angle piece so that it, in each particular case, corresponds the excentricity of the conductors in the contact rail to be connected to same, irrespective of whether the angle piece is turned to the right or to the left for connecting the next contact rail. Thus, only one type of angle pieces is sufficient.

Since the contact fingers of both end portions of the angle piece are compulsorily shifted as one entity, this ascertains that the phases of the conductors in the leaving contact rail remain the same as in the incoming contact rail, because the eccentricity of the contact fingers is at the same time changed in both end portions of the angle piece.

BRIEF DESCRIPTION OF THE DRAWINGS

The invention will be described more closely below with reference to the attached drawings, wherein.

DESCRIPTION OF THE PREFERRED EMBODIMENT

Figure 1:
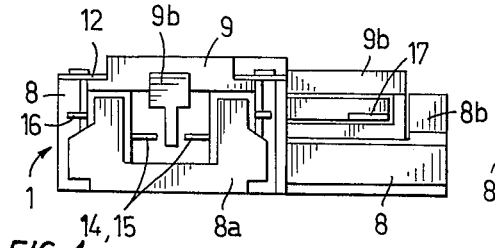
FIGS. 1, 2, 3, and 4 show a favorable embodiment of the angle piece in accordance with the invention as viewed from the end, from the side, from above and from underneath, respectively.
Figure 2:
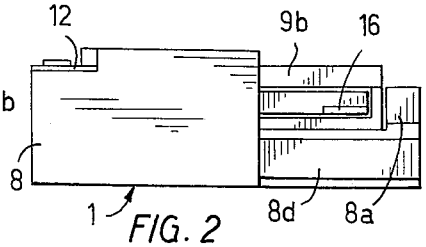
Figure 3:
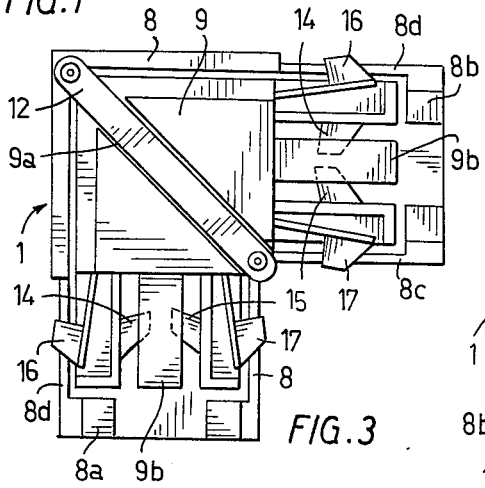
Figure 4:
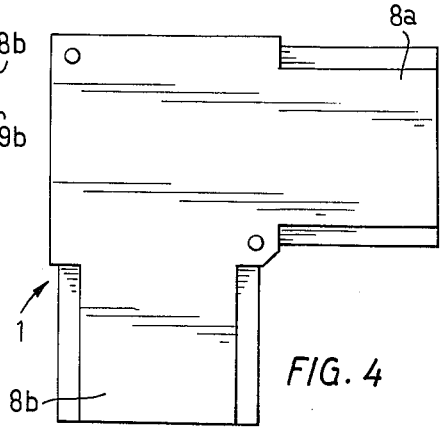
Figure 5:
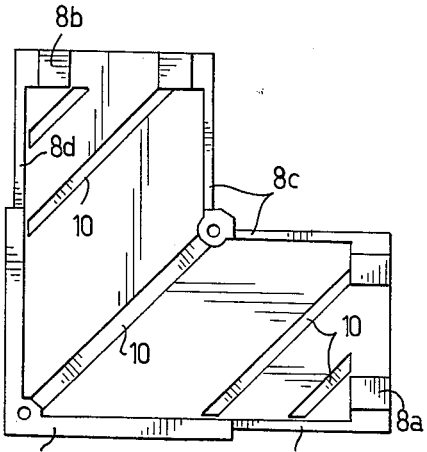
FIG. 5 shows a top view of the body portion of the angle piece.
Figure 6:
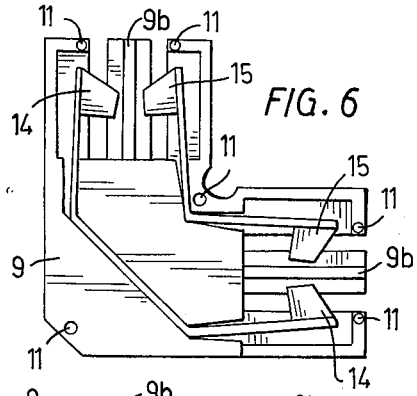
FIGS. 6 and 7 show the installation portion of the angle piece as viewed from underneath and from the end, respectively.
Figure 7:
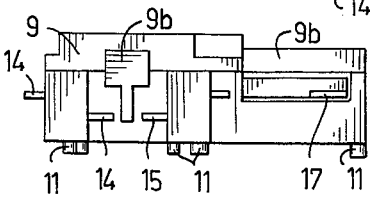
Figure 8:
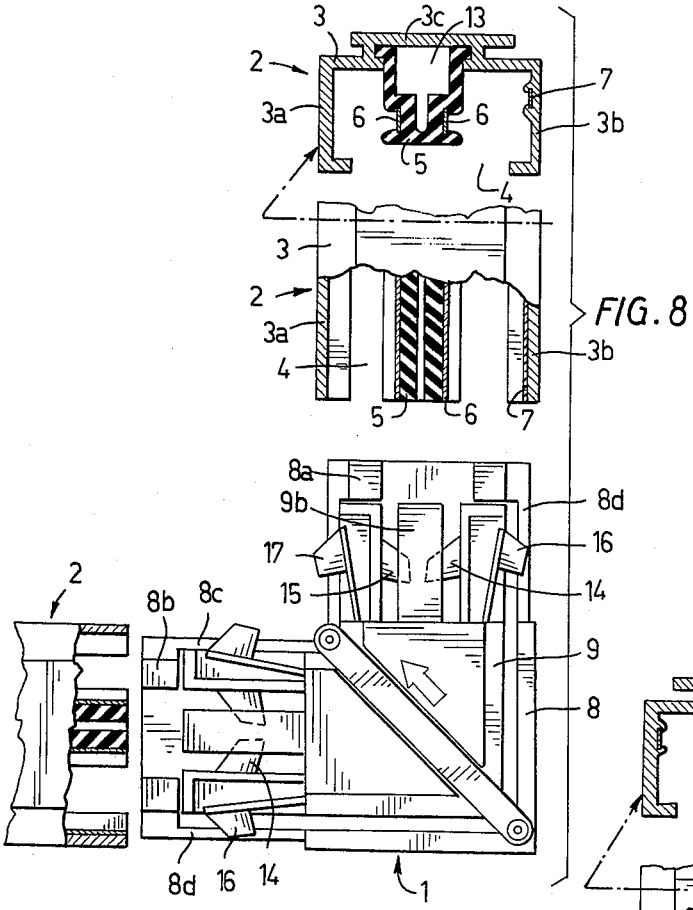
FIGS. 8 and 9 show top view of an angle piece as used for connecting contact rails in opposite directions.
Figure 9:
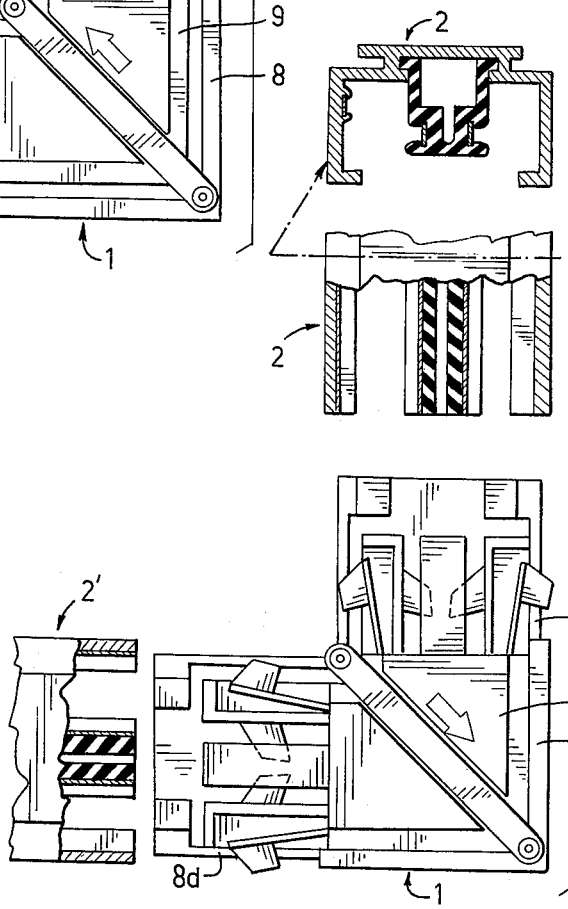

The angle piece 1 shown in the drawings is intended for the contact rail 2, which is illustrated more closely in FIGS. 8 and 9. The contact rail 2 comprises a metallic support body 3 of U-shaped cross-section, between the flanks of which, 3*a*, 3*b*, a longitudinal groove 4 is formed. An insulating list 5 is fastened to the bottom 3*c* of the support body, which list is provided with longitudinal phase conductors 6, and the zero conductor 7 is fastened to the other flank 3*b*. The insulating list with its conductors is here fastened to the support body eccentrically in relation to its flanks so that the insulating list with conductors is placed closer to one of the sides — in this case flank 3*a*.

The angle piece 1 comprises an L-shaped body portion 8, which forms two end portions 8*a*, 8*b*, whose outer profile is such that the end portion fits inside the flanks 3*a*, 3*b* of the support body of the contact rail. The angle piece further comprises a, likewise L-shaped, installation portion 9, which is fitted onto the body portion as sliding in the diagonal direction to the body portion. This has been achieved by making the installation portion slightly narrower than the body portion so that the installation fits with some play between the inner flank 8*c* and the outer flank 8*d* of the body portion and by providing the bottom of the body portion with diagonal guide grooves 10 and the installation portion which corresponding guide pins 11, which extend into the grooves and slide in them. The installation portion is fastened to the body portion by means of the bracket 12, which is placed in a guide groove 9a in the installation portion.

Both ends of the installation portion are provided with central T-shaped stop projections 9b, whose shape is such that it fits into a corresponding T-shaped notch 13 in the insulation list in the contact rail.

The installation portion is, moreover, provided with four contact fingers 14, 15, 16, 17, which consist of metal strips and extend from one end of the installation portion to the other. Then, two contact fingers 14, 15 are directed towards the central stop projection 9b and two contact fingers 16, 17 are directed away from the stop projection. The contact fingers are then fitted onto the installation portion so that the contact fingers 14, 15 are placed at the level of the phase conductors 6 in the contact rail and the contact fingers 16, 17 at the level of the zero conductor 7 when the end portion of the angle piece is inserted into the contact rail.

When the angle piece is used for connecting a contact rail 2 to a contact rail 2' going to the left in FIG. 8, the installation portion 9 is shifted so as to lie against the inner flank 8c of the angle piece so that the eccentricity of the contact fingers of the angle piece in relation to the flanks 8c, 8d comes to correspond the eccentricity of the conductors in the contact rail in relation to the flanks 3a, 3b. It is only in this position that the end portion of the angle piece can be pushed between the flanks of the contact rail so that the stop projection 9b fits into the notch 13 in the insulation list. Then the contact fingers at the other end of the angle piece have also assumed an eccentric position against the inner flank 8c so that the support rail 2' can be pushed onto the other end portion of the angle piece only in the position shown in FIG. 8, in which the conductors are placed eccentrically towards the flank 3a. The contact fingers 14, 15 are then in contact with the phase conductors 6 of the contact rail and the contact finger 16 is in contact with the zero conductor 7.

When, to a contact rail 2 the eccentricity whose conductors is opposite to that in FIG. 8, a contact rail 2' going to the left in FIG. 9 is to be connected, the installation portion 9 of the angle piece is pressed against the outer flank 8d, whereupon the connecting can be accomplished as shown in FIG. 9.

The drawings and the related description are only intended to illustrate the idea of the invention. In its detail, the angle piece in accordance with the invention may vary even to a considerable extent within the scope of the patent claims. Thus, the angle piece does not necessarily have to be rectangular.

What I claim is:

1. An angle piece for a contact rail, comprising: the rail including a support body of U-shaped section having longitudinal conductors placed in a longitudinal groove of said support body eccentrically in relation to sides of said support body, said angle piece having end, portions and an L-shaped body portion which can be pushed into said groove of the support body longitudinally, said L-shaped body portion having at each end portion contact fingers for contacting the conductors in the support body, said contact fingers being placed eccentrically in relation to inner and out flanks of the L-shaped body portion an L-shaped installation component, said contact fingers being mounted onto said installation component supported by said L-shaped body portion and being adjustable in relation to said body portion, said L-shaped installation component being shiftable in relation to the body portion in its diagonal direction so that said contact fingers can be selectively adjusted for coming closer to the inside flank or closer to the outside flank of the body portion.

2. An angle piece as claimed in claim 1, wherein said L-shaped body portion has diagonal guide grooves and said installation component has guide pins penetrating into said guide grooves.

3. An angle piece as claimed in claim 1 wherein conductors in the contact rail are mounted on an insulating list projecting from the bottom of the support body, said insulating list having a slit means for receiving a counter-projection placed on the angle piece, said counter-projection on the angle piece being placed on the adjustable installation component.

* * * * *